US008074839B2

(12) United States Patent
Ronsin et al.

(10) Patent No.: US 8,074,839 B2
(45) Date of Patent: Dec. 13, 2011

(54) FLUID PRODUCT DISPENSING ASSEMBLY

(75) Inventors: Hervé Ronsin, Malestroit (FR); Julien Trossat, Paris (FR)

(73) Assignee: Shiseido International France, Paris (FR)

( * ) Notice: Subject to any disclaimer, the term of this patent is extended or adjusted under 35 U.S.C. 154(b) by 355 days.

(21) Appl. No.: 11/791,743

(22) PCT Filed: Dec. 1, 2005

(86) PCT No.: PCT/FR2005/051023

§ 371 (c)(1),
(2), (4) Date: May 29, 2007

(87) PCT Pub. No.: WO2006/059046

PCT Pub. Date: Jun. 8, 2006

(65) Prior Publication Data

US 2008/0011778 A1 Jan. 17, 2008

(30) Foreign Application Priority Data

Dec. 2, 2004 (FR) ..... 04 52844

(51) Int. Cl.
*B65D 35/22* (2006.01)

(52) U.S. Cl. ..... 222/94; 222/131; 222/382; 222/183; 222/321.7; 222/383.1; 215/12.2

(58) Field of Classification Search ..... 222/183, 222/321.7, 325, 94, 131, 382, 383.1, 154, 222/156; 215/12.2

See application file for complete search history.

(56) References Cited

U.S. PATENT DOCUMENTS

| | | | | |
|---|---|---|---|---|
| 3,198,400 | A * | 8/1965 | Roehrich | 222/182 |
| 3,876,115 | A | 4/1975 | Venus, Jr. et al. | |
| 4,256,231 | A | 3/1981 | Cioc et al. | |
| 4,446,991 | A | 5/1984 | Thompson | |
| 4,457,455 | A * | 7/1984 | Meshberg | 222/105 |
| 4,969,577 | A * | 11/1990 | Werding | 222/94 |
| 5,137,179 | A * | 8/1992 | Stoffel | 222/95 |
| 5,199,609 | A * | 4/1993 | Ash, Jr. | 222/94 |
| RE36,410 | E * | 11/1999 | Meshberg | 141/2 |
| 6,070,763 | A * | 6/2000 | Gueret | 222/95 |
| 6,352,182 | B1 * | 3/2002 | Gueret | 222/321.9 |
| 6,371,334 | B1 | 4/2002 | Lombardi | |
| 6,543,653 | B2 * | 4/2003 | Lamboux | 222/321.8 |
| 6,672,479 | B2 * | 1/2004 | Shiraishi et al. | 222/105 |
| 7,021,495 | B2 * | 4/2006 | De Laforcade | 222/105 |
| 7,308,991 | B2 * | 12/2007 | Alberg | 222/105 |
| 2002/0113093 | A1 * | 8/2002 | De Laforcade | 222/321.9 |
| 2005/0067432 | A1 * | 3/2005 | Bonneyrat | 222/105 |

FOREIGN PATENT DOCUMENTS

| | | | |
|---|---|---|---|
| EP | 0 248 755 | A2 | 12/1987 |
| FR | 2 341 500 | A1 | 9/1977 |
| FR | 2 786 754 | A1 | 6/2000 |
| JP | 4-102566 | A | 4/1992 |
| WO | WO 88/08334 | A1 | 11/1988 |
| WO | WO 03/039292 | A1 | 5/2003 |

* cited by examiner

*Primary Examiner* — Frederick C Nicolas
*Assistant Examiner* — Donnell Long
(74) *Attorney, Agent, or Firm* — Sughrue Mion, PLLC

(57) ABSTRACT

A fluid dispenser assembly includes an outer receptacle with an opening, the receptacle including an inside wall defining an inside space; internal trim disposed in the inside space; a dispenser member, such as a pump, for dispensing the fluid; and a barrier envelope for containing the fluid, the envelope being disposed inside the internal trim so that the fluid is not in contact with said internal trim. The receptacle is made of a transparent or translucent material, such as glass, so that the internal trim is visible through the receptacle, and the internal trim is substantially opaque so as to mask at least some, and preferably all, of the barrier envelope.

20 Claims, 3 Drawing Sheets

FLUID PRODUCT DISPENSING ASSEMBLY

The present invention relates to a fluid dispenser assembly comprising: a receptacle defining an inside space; internal trim disposed in the inside space; and a dispenser member, such as a pump, for dispensing the fluid.

The present invention applies preferably, but not exclusively, to the fields of perfumery and of cosmetics.

Numerous fluid dispenser assemblies have been developed in the prior art. The fluid contained in such assemblies can be a lotion, a cream, or a perfume, for example. Such assemblies, similar to luxury goods, require a particularly neat appearance in order to attract the consumer. Thus, the designers of such assemblies can work on various parameters so as to enhance them, such as their shape, their color, or even their design the material(s). One of the ways such materials can be implemented consists in particular in positioning internal trim in a fluid reservoir. By way of example, the internal trim may correspond to leaves of plastics material provided with inscriptions or decorative patterns and disposed to float in the fluid reservoir. The leaves, having a decorative and/or informative purpose, can thus be seen by transparency through the fluid reservoir, thereby imparting an overall attractive appearance that is particularly advantageous.

However, physico-chemical interactions are likely to occur between the fluid and the internal trim. Such interactions can thus give rise to a change in the physico-chemical composition of the fluid to be dispensed, which is likely to lead to changes in the properties or the appearance of the fluid. Consequently, those effects are particularly troublesome. As a result, it is therefore very difficult to make a dispenser assembly with internal trim that will not to harm the integrity of the fluid to be dispensed.

Thus, an object of the present invention is to overcome the above-mentioned drawbacks of the prior art.

In particular, an object of the present invention is to provide a dispenser assembly that is provided with internal trim that will not lead to physico-chemical changes in the fluid contained in the reservoir.

Another object of the present invention is to provide a dispenser assembly that presents an appearance that is particularly original and attractive.

Another object of the present invention is to provide a dispenser assembly that is simple to manufacture and to assemble and that is inexpensive.

Another object of the present invention is to guarantee the integrity of the fluid to be dispensed, even when the receptacle presents a very small opening compared to the body of the receptacle.

The present invention thus provides a fluid dispenser assembly comprising: an outer receptacle including an opening, said receptacle including an inside wall defining an inside space; internal trim disposed in the inside space; and a dispenser member, such as a pump, for dispensing the fluid; the assembly being characterized in that it further comprises a barrier envelope for containing the fluid, said envelope being disposed inside the internal trim so that the fluid is not in contact with said internal trim, in that said receptacle is made of a transparent or translucent material, such as glass, so that the internal trim is visible through the receptacle, and in that the internal trim is opaque so as to mask at least some, and preferably all, of said barrier envelope. This particular disposition thus makes it possible to separate the internal trim from the fluid to be dispensed, and thus makes it possible to avoid any spoilage of the fluid through contact with the trim. Furthermore, the invention imparts a particularly attractive decorative appearance to the dispenser assembly.

In an advantageous embodiment, the barrier envelope is flexible, in such a manner as to be insertable through the opening in the receptacle and deployable inside the trim. The deformation properties of such a flexible envelope or pouch make it possible to insert and deploy said envelope or pouch easily in the inside space by being inserted through the opening defined by the neck of the outer receptacle. Such insertion can thus be carried out with the envelope folded or rolled up. Then, the envelope unfolds in such a manner as to occupy substantially all of the inside space. In particular, such a flexible pouch is perfectly suited for use with perfume bottles. That type of bottle generally includes a top end provided with a shoulder from which there extends a neck defining an opening of small diameter. Thus, if the reservoir is formed by a flexible pouch, said pouch can unfold in such a manner as to extend up to just under the shoulder, so that the volume occupied by the fluid is maximized relative to the inside space defined by the outer receptacle. The use of such a pouch thus makes it impossible to mislead the purchaser of such a bottle about the quantity of fluid present in the outer receptacle. In this embodiment, the barrier envelope may thus be defined as a fluid reservoir that is a perfect match to the inside space defined by the outer receptacle. The outer receptacle may itself be defined as a covering shell for covering a fluid reservoir.

The use of a flexible pouch disposed in a rigid outer receptacle or shell is already known in the prior art. The pouch thus serves as a reservoir without air and without an air intake. In the present invention, the flexible pouch is used as a barrier for separating the fluid from the trim with which it might react.

In another advantageous embodiment of the invention, the barrier envelope is formed by a coating applied to the trim. In this event, the barrier envelope thus forms a layer that covers the internal trim. The layer constitutes an interface between the internal trim and the fluid to be dispensed, and avoids any possibility of contact between said trim and said fluid.

According to another characteristic, the barrier envelope extends inside the trim, and, at least locally, it is not in contact with the trim. This is what happens with a flexible pouch, for example.

In a variant embodiment, the barrier envelope comprises a rigid reservoir, advantageously made of glass, that is disposed inside the receptacle by means of a support that is engaged with the opening in the receptacle. This disposition ensures that a fluid reservoir is held in stable manner relative to an outer receptacle. In this configuration, the outer receptacle can be considered as being a covering shell for covering a fluid reservoir. The fluid reservoir may itself form a fluid refill that can be replaced at will by the user. The fact of replacing only the refill and not the dispenser device as a whole naturally has the advantage of reducing the long-term purchase cost of such a dispenser device, since only the refill needs to be replaced. It should be observed that such a configuration is particularly advantageous for outer receptacles that present an elongate shape so that the volume occupied by the fluid reservoir is not too small compared to the inside space defined by the outer receptacle.

Advantageously, the trim is flexible, and, at least locally, it does not extend in contact with the trim. The trim can thus be floatingly mounted in an intermediate gap that is situated between the inside wall of the outer receptacle and the fluid reservoir that can be rigid or flexible.

The trim is preferably formed by a coating, such as a lacquer or a varnish, that is applied to the inside wall of the receptacle. The trim may extend over all or part of the inside wall of the receptacle. Some zones of the inside wall may remain bare.

Advantageously, said dispenser member is a pump, of the atmospheric or airless type, that is suitable for taking the fluid contained in said barrier envelope. Advantageously, said envelope is vented by an atmospheric pump and/or by a vent hole formed in the neck of the receptacle.

It should be observed that the use of an atmospheric pump mounted in a flexible envelope together with the venting of such a flexible envelope may be implemented and protected independently of the characteristics associated with the trim. By venting the flexible pouch, said pouch is caused to depart from its original function, namely that of keeping the fluid that it contains out of contact with ambient air. Venting a flexible pouch is thus surprising, since it goes against its conventional use. In addition, venting the pouch makes it possible to maintain it in its maximally-deployed configuration. The formation of folds and of compartments that might trap some of the fluid are thus avoided.

Advantageously, said envelope is fastened directly onto the opening in the receptacle by pinching it between the top edge of the neck and a gasket. This disposition makes it possible to dispense with the use of a specific support for holding the barrier envelope in position in the outer receptacle. Dispensing with such a part naturally has the effect of lowering the overall cost of the dispenser device. In addition, assembling said envelope is made easier as a result of eliminating the step of bonding the pouch to its support by ultrasound, which step is conventionally implemented with this type of pouch. Furthermore, it is possible to use a pump of greater diameter, since space is freed up in the opening in the receptacle as a result of the absence of a pouch support that normally surrounds the pump.

Advantageously, said internal trim is physically or chemically incompatible with the fluid to be dispensed.

Advantageously, the fluid is perfume.

Advantageously, said opening in the outer receptacle presents an inside diameter that lies in the range 8 millimeters (mm) to 20 mm. The body of the receptacle may present a diameter that is substantially greater than 20 mm.

The invention is described more fully below with reference to the accompanying drawings which show several embodiments of the invention by way of non-limiting example, and in which.

Figure 1:
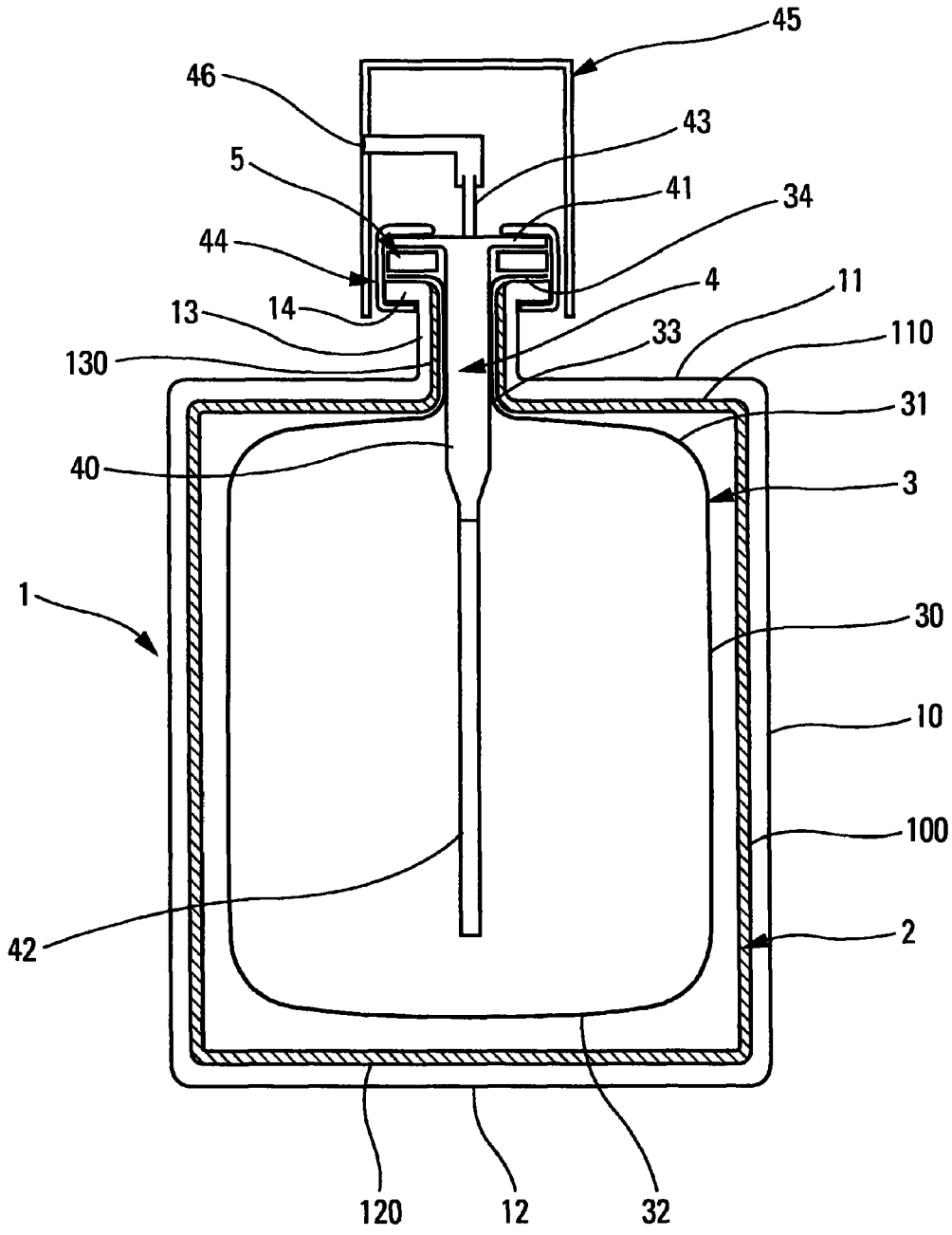
FIG. 1 is a diagrammatic section view of a dispenser assembly constituting a first embodiment of the invention.

With reference to figures, the fluid dispenser assembly of the invention comprises an outer receptacle 1, internal trim 2, 2', and a barrier envelope 3, 3', 3".

The outer receptacle 1 is made of a transparent or translucent material, such as a plastics material, or preferably of glass. The receptacle 1 comprises a side wall 10 having a bottom end that is closed by a bottom wall 12 and a top end that is provided with a neck 13. The neck 13 presents a dimension, in cross-section, that is smaller than the dimension, in cross-section, of the side wall 10, and it is connected to the side wall 10 by a shoulder 11 that is preferably substantially radial. The neck 13 projects upwards from the shoulder 11 and defines a top edge 14. Such a neck defines an opening that puts the inside of the outer receptacle into communication with the outside. The diameter of the opening is advantageously about 8 mm to 20 mm, with this range corresponding to standard neck diameters for bottles in the fields of perfumery and of cosmetics.

The bottom wall 12, the wall 10, the shoulder 11, and the neck 13 respectively define an inside surface 120, 100, 110, 130. The inside surfaces together define the inside wall of the outer receptacle. The inside wall thus defines an inside space that is accessible via the opening in the neck 13.

It should be observed that the outer receptacle can present any appropriate configuration, such as a configuration that is cylindrical, spherical, parallelepipedal, cubic, etc., the invention not being limited to any particular shape.

Two embodiments of the internal trim 2, 2' are shown in the figures.

Figure 4:
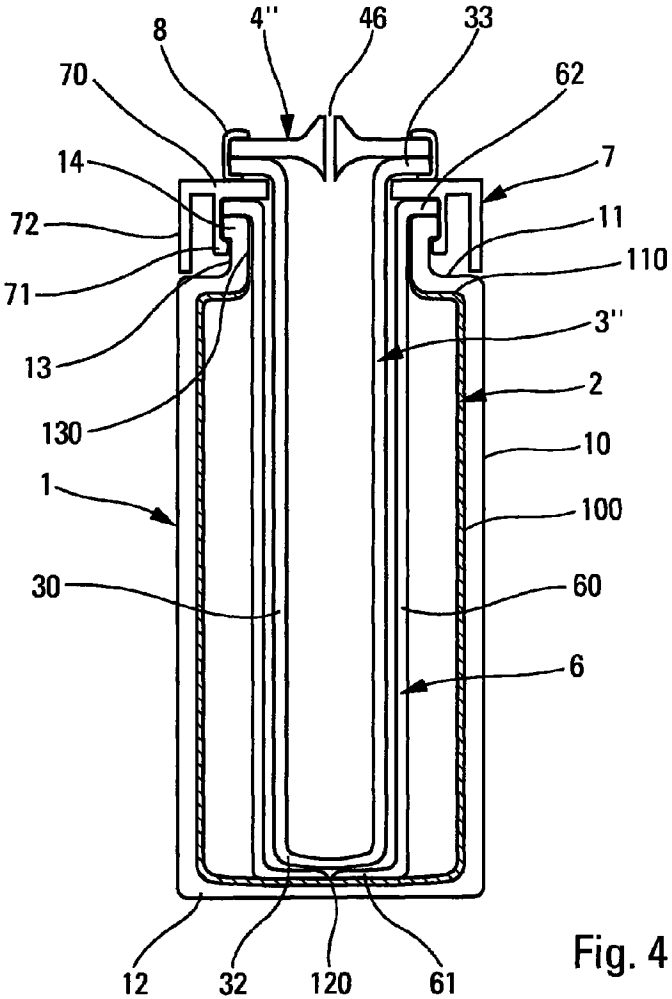
FIG. 4 is a diagrammatic section view of a dispenser assembly constituting a fourth embodiment of the invention.
Figure 3:
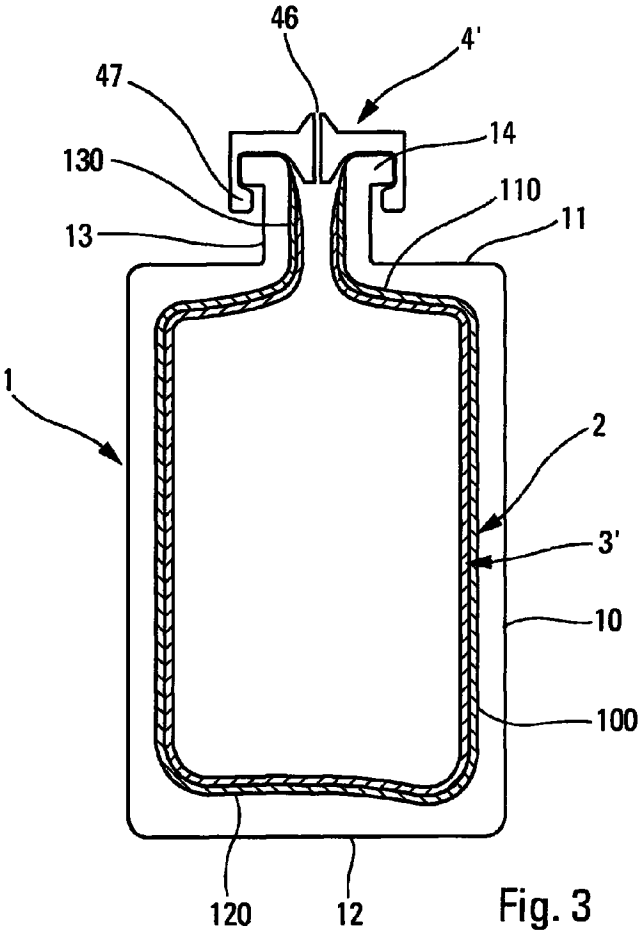
FIG. 3 is a diagrammatic section view of a dispenser assembly constituting a third embodiment of the invention.

FIGS. 1, 3, and 4 show internal trim 2 in the form of a layer or of a coating that lines the inside wall of the outer receptacle 1. Advantageously, the coating is a lacquer, a paint, or a finishing varnish that is applied to all or only part of the inside wall of the receptacle. By way of example, the lacquer, the paint, or the varnish can be applied by means of a spray nozzle inserted in the opening defined by the neck 13 of the receptacle.

Figure 2:
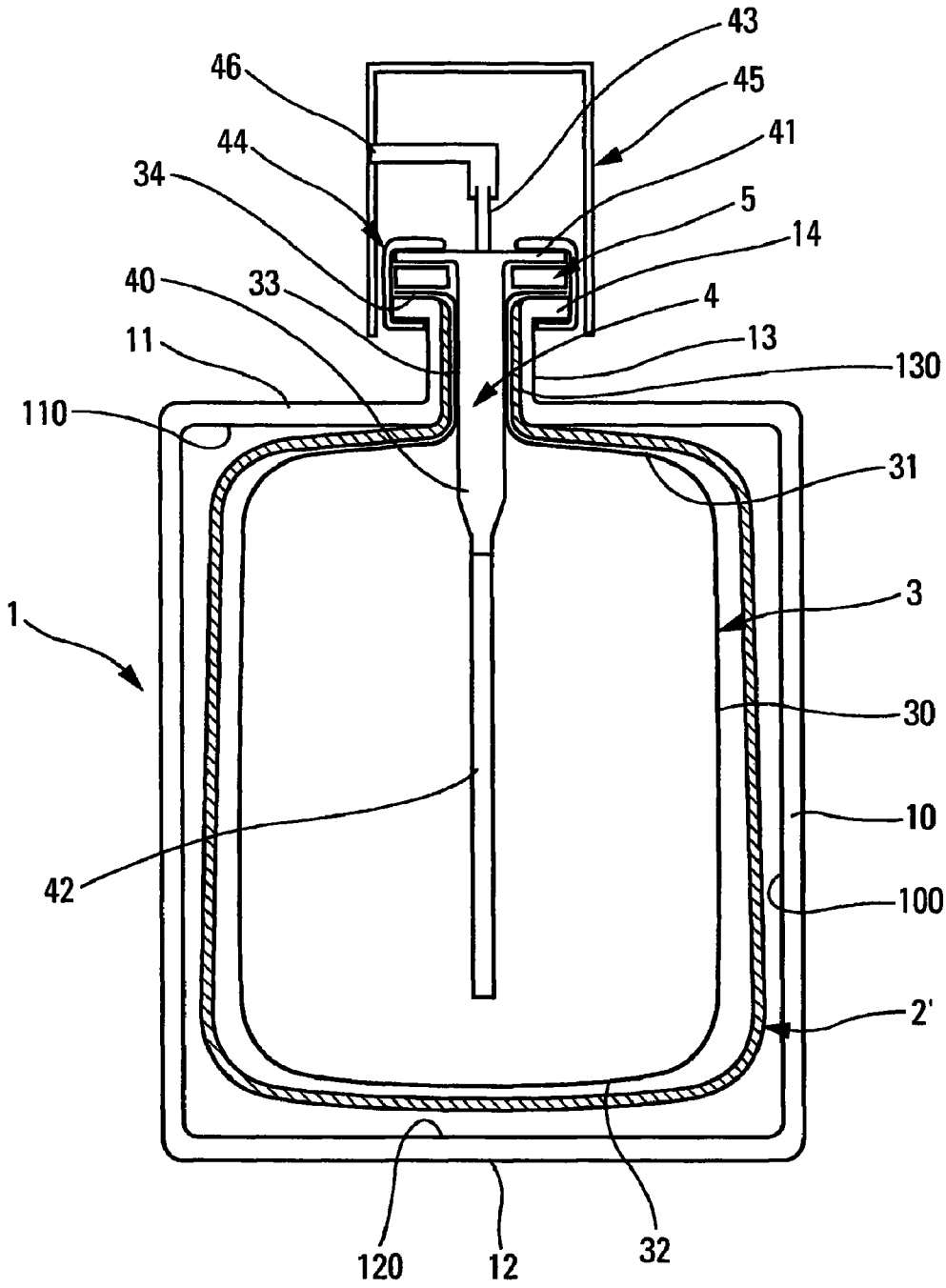
FIG. 2 is a diagrammatic section view of a dispenser assembly constituting a second embodiment of the invention.

FIG. 2 shows internal trim 2' that is loosely or floatingly mounted in the inside space of the outer receptacle. By way of example, the trim can be in the form of leaves made of plastics material. The leaves can thus be fastened at the top edge 14 of the neck by heat-sealing or by pinching. The trim can also be completely floating without being fastened to the receptacle.

It should be emphasized that the internal trims 2, 2' have the feature of being made of a material that is substantially opaque. This opacity enables a trim to be visible from the outside through the transparent or translucent walls of the receptacle, and thus enables a user to distinguish clearly the outline or the shape of the trim relative to the receptacle as such. Furthermore, such opacity has the advantage of masking part or all of the barrier envelope 3, 3', 3", depending on the degree to which said trim is distributed in the receptacle. In other words, the barrier envelope 3, 3', 3" is not visible from the outside at locations where the trim is provided.

Three embodiments of the barrier envelope are described below. The barrier envelope 3, 3', 3" is for receiving or for being in contact with the fluid to be dispensed. Strictly speaking, the envelope thus constitutes the fluid reservoir. Advantageously, the fluid contained in the reservoir is a perfume, a cream, or a lotion that is chemically or physically incompatible with the internal trim.

FIGS. 1 and 2 show a flexible or deformable barrier envelope 3. The envelope corresponds to a flexible pouch that is generally encountered in "airless" systems. Such flexible pouches are foldable and are thus suitable for being inserted through the opening in the neck, in such a manner as to be placed in the inside space defined by the receptacle 1. They are generally made from a laminated film made of aluminum and plastics material.

The flexible pouch comprises a peripheral wall 30 having a bottom end that is closed by a bottom wall 32 and a top end that is provided with a neck 33 defining an opening. A substantially-radial shoulder 31 forms the junction between the neck 33 and the peripheral wall 30.

Once inserted in the inside space of the receptacle 1, the bottom wall 32, the wall 30, and the shoulder 31 are deployed in such a manner as to occupy substantially all of the inside space. The flexible pouch can thus be dimensioned so that the bottom wall 32, the wall 30, and the shoulder 31 respectively come into contact against the inside surfaces of the bottom wall 12, of the wall 10, and of the shoulder 11 of the outer receptacle 1.

Once the flexible pouch is in place, the flexible pouch can be filled with fluid. An outwardly-extending rim can thus be formed at the top end of the neck 33 of the pouch. The rim thus forms a radial flange 34 that is suitable for resting on the top edge 14 of the neck. An O-ring 5 can then be interposed between the radial flange and a dispenser member 4, so as to fasten the dispenser member in leaktight manner to the pouch.

The dispenser member 4 can be a pump. The pump can be of the atmospheric type, i.e. with an air inlet, or it can be of the airless type, i.e. without an air inlet. It should be observed that an atmospheric pump is advantageously used in such a manner that the pouch maintains a substantially constant volume as the fluid is dispensed. The volume of fluid expelled is substituted by an equivalent volume of incoming air. The incoming air thus generally passes through a vent hole that is formed directly in the pump itself. Consequently, the flexible pouch does not collapse in on itself, unlike when using an airless pump, and therefore does not presents folds that are responsible for trapping fluid. Alternatively, a similar result can be obtained with an airless pump if a vent hole is provided at the neck of the bottle in such a manner as to allow atmospheric air to penetrate into said flexible pouch. Finally, if an airless pump is used without venting the flexible pouch, the fluid is protected from the air. Isolating the fluid thus makes it possible to avoid any bacterial contamination of or physicochemical modification to the fluid contained in the flexible pouch.

In conventional manner, the pump comprises a body 40 that is provided at its top end with a collar 41 for coming to bear against the O-ring 5, and at its bottom end with a fastener sleeve for fastening a dip tube 42. A fastener ring 44 holds the flexible pouch 3, the O-ring 5, and the dispenser member 4 at the neck of the outer receptacle. The ring can be a crimping, snap-fastener, or screw-fastener ring. An actuator rod 43, that is suitable for being displaced by sliding in leaktight manner in the body 40, is provided so as to vary the volume of a metering chamber that is generally defined by inlet and outlet valve members. Internally, the rod defines an outlet channel for the fluid contained in the metering chamber. As shown in FIGS. 1 and 2, the actuator rod can be connected to a pusher 45 that forms a dispenser orifice 46.

In this particular embodiment, the fluid contained in the flexible pouch 3 is dispensed by manually exerting axial pressure on the pusher. The use of an atmospheric pump enables the flexible pouch to maintain a constant volume as explained above. In contrast, when an airless pump is used, each actuation tends to reduce the volume of the flexible pouch 3 progressively.

In a second embodiment shown in FIG. 3, the barrier envelope 3' advantageously forms a coating applied to the internal trim 2. The coating thus forms an overlay on the internal trim 2 that is pressed against the inside wall of the receptacle 1. In the embodiment in FIG. 3, the inside wall of the receptacle is completely covered with internal trim and the barrier envelope completely covers the internal trim. It can also be envisaged that the trim is perforated locally, so that the barrier envelope is visible. The fluid contained inside the barrier envelope 3' thus cannot, in any event, enter into contact with the internal trim 2. It should be observed that such a barrier envelope in the form of a coating can also be applied to internal trim that is floatingly mounted.

In the embodiment in FIG. 3, the dispenser member is formed by a cap 4' that is provided with an outlet orifice 46. The cap can be secured to the outer receptacle by means of snap-fastener tabs or by means of a snap-fastener ring 47 that comes to be housed below the top edge 14 of the neck. It is also possible for the cap to present a self-sealing lip. In this event, the side wall 10 of the outer receptacle is deformable, and manually exerting pressure on the wall tends to cause the fluid to be displaced towards the lip. This displacement of fluid thus leads to the lip half opening, which results in fluid being expelled.

In a third embodiment shown in FIG. 4, the dispenser assembly includes a barrier envelope in the form of a rigid reservoir 3" that is advantageously held in the receptacle 1 by a support 6.

The support 6 forms a case that is suitable for extending inside the internal trim 2 that is provided in the form of a coating applied to the inside wall of the receptacle 1. The case can comprise a body 60 that is provided with a bottom end that is closed by a bottom wall 61 and with a top end defining an opening. The top end can include a bearing flange 62 that is suitable for coming to bear against the top edge 14 of the neck in the assembly position. It should be observed that it is desirable for the cylindrical body to present an outside diameter that is substantially equal to, or slightly smaller than, the inside diameter of the neck 13, in such a manner that the case fills the inside space optimally. In addition, the bottom wall 61 of the case can come into abutment against the bottom wall 120 of the outer receptacle.

The case can be held in place on the neck 13 of the receptacle by means of a fastener member 7. The fastener member 7 comprises a radial disk 70 through which a substantially central opening passes. An inner skirt 71 and a peripheral skirt 72 extend downwards from the radial disk. The inner skirt can be provided with projections that project radially inwards and that are suitable for snap-fastening below the top edge 14 of the neck. This snap-fastening thus makes it possible to hold the case 6 in position on the neck by pinching the bearing flange 62 between the top edge 14 of the neck and a portion of the radial disk 70. In addition, the peripheral skirt 72 can be positioned in alignment with the side wall 10 of the outer receptacle when the fastener member 7 is finally assembled on the neck.

The rigid reservoir 3" forms an elongate tube that is suitable for being received in the case 6 that is already positioned in the outer receptacle. The rigid reservoir 3" can be made of plastics material, or advantageously of glass. The rigid reservoir comprises a cylinder 30 that is provided with a bottom end that is formed by a bottom wall 32 and with a top end defining an opening. The top end advantageously includes a projecting neck 33. In addition, a cap 4" that is provided with an outlet hole 46 can be assembled at the top end of the reservoir 3". The cap can be secured to the reservoir by means of a fastener ring 8. The reservoir 3" can be inserted through the respective openings of the fastener member 7 and of the case 6, in such a manner as to extend inside the case. The final position of the reservoir is achieved when the fastener ring 8 comes to bear against the radial disk 70 of the fastener member 7. The reservoir can be extracted easily from the case, and can thus be used as a replaceable refill at will by the user, once its content have been used up. It should be observed that it is desirable for the reservoir 3" to match the appearance of the case perfectly. The reservoir thus advantageously presents an outside diameter that is substantially equal to, or slightly smaller than, the inside diameter of the case, and the bottom wall 32 of the reservoir advantageously comes into contact with the bottom wall 61 of the case when the reservoir is assembled in its final position in the case. Such a configuration thus makes it possible to have a dispenser assembly with a refill presenting an optimum volume of fluid.

Although the present invention is described above with reference to particular embodiments, any useful modifications could be applied thereto by the person skilled in the art, without going beyond the ambit of the present invention, as defined by the accompanying claims.

The invention claimed is:

1. A fluid dispenser assembly comprising:

an outer receptacle (1) including an opening, said receptacle including an inside wall defining an inside space, said opening defining an internal periphery that is smaller than an internal periphery of the inside wall, said receptacle (1) made of a transparent or translucent material formed of glass;

internal trim (2, 2') disposed in the inside space, the internal trim (2, 2') visible through the receptacle (1);

a dispenser member (4; 4'; 4") for dispensing the fluid said dispenser member mounted in the opening of the receptacle; and a barrier envelope (3, 3', 3") for containing the fluid, said envelope disposed inside the internal trim (2, 2') so that the fluid is not in contact with said internal trim (2, 2'), the internal trim (2, 2') opaque so as to mask at least some of said barrier envelope (3, 3', 3"), wherein the barrier envelope (3) is flexible and inserted through the opening in the receptacle (1) and deployed inside the trim (2, 2'), and the trim (2) is formed by a coating that is applied to the inside wall of the receptacle (1).

2. A dispenser assembly according to claim 1, in which the barrier envelope (3; 3") extends inside the trim (2; 2'), and, at least in one random location, it is not in contact with the trim (2; 2').

3. A dispenser assembly according to claim 1, in which said envelope (3) is fastened directly onto the opening in the receptacle (1) by pinching it between the top edge (14) of the neck and a gasket (5).

4. A dispenser assembly according to claim 1, in which said internal trim (2; 2') is physically or chemically incompatible with the fluid to be dispensed.

5. A dispenser assembly according to claim 1, in which the fluid is perfume.

6. A dispenser assembly according to claim 1, in which said opening in the outer receptacle (1) presents an inside diameter that lies in the range 8 mm to 20 mm.

7. A dispenser assembly according to claim 1, in which said dispenser member (4) is a pump that is suitable for taking the fluid contained in said barrier envelope (3).

8. A dispenser assembly according to claim 1, in which said envelope (3) is vented by an atmospheric pump and/or by a vent hole formed in the neck (13) of the receptacle (1).

9. The dispenser assembly according to claim 1, wherein the receptacle is a one-piece integral construction.

10. The dispenser assembly according to claim 7, wherein the pump is an atmospheric or airless pump.

11. The dispenser assembly according to claim 1, wherein the internal trim masks all of the barrier envelope.

12. A fluid dispenser assembly comprising:

an outer receptacle comprising an opening of a reduced neck that connects the opening to a larger space defined by one or more inside walls of the receptacle defining an inside space, such that an internal periphery of the neck is smaller than an internal periphery of the inside wall, the receptacle made of a transparent or translucent material formed of glass;

an internal trim disposed in the inside space, the internal trim visible through the receptacle;

a dispenser member for dispensing fluid, the dispenser member mounted in the opening and neck of the receptacle; and a barrier envelope for containing the fluid, the envelope disposed inside the internal trim so that the fluid does not contact the internal trim, the internal trim opaque so as to mask at least a portion of the barrier envelope, the barrier envelope is flexible and inserted in the receptacle through the opening and the neck and deployed inside the trim.

13. The dispenser assembly according to claim 12, wherein the receptacle is a one-piece integral construction.

14. The dispenser assembly according to claim 12, wherein the dispenser member is an atmospheric or airless pump.

15. The dispenser assembly according to claim 12, wherein the internal trim masks all of the barrier envelope.

16. The dispenser assembly according to claim 12, wherein, the trim is formed by a coating applied to the inside wall of the receptacle.

17. The dispenser assembly according to claim 1, wherein the coating is a lacquer or varnish.

18. The dispenser assembly according to claim 1, wherein said barrier envelope has a bottom wall, a peripheral wall, and a neck, and a substantially radial shoulder forming a junction between the neck and the peripheral wall of said barrier envelope, so that the bottom wall, the peripheral wall and the shoulder occupy substantially all of the inside space of the outer receptacle once the barrier envelope is deployed inside the trim.

19. The dispenser assembly according to claim 1, wherein said outer receptacle includes a side wall having a bottom end, which is closed by a bottom wall, and a top end, which includes a substantially radially shoulder connected to the opening, wherein the opening includes a neck extending between the substantially radial shoulder and a top edge which radially extends outward from the neck, and wherein said barrier envelope includes a radial flange formed at the opening of the barrier envelope that radially projects from the opening of the barrier envelope and has a diameter greater than a diameter of an outer surface of the neck of the outer receptacle.

20. The dispenser assembly according to claim 18, wherein the radial shoulder and the peripheral wall define a substantially right angle such that the barrier envelope conforms to the shape of the inside space of the outer receptacle.

* * * * *